US005664493A

United States Patent [19]

Kim

[11] Patent Number: 5,664,493

[45] Date of Patent: Sep. 9, 1997

[54] WASTE, GLASS, AND PLASTIC COMPACTOR

[76] Inventor: Dong Ik Kim, P.O. Box 747, Pago Pago, American Samoa, 96799

[21] Appl. No.: 324,180

[22] Filed: Oct. 14, 1994

[51] Int. Cl.[6] ..... B30B 15/34; B30B 15/08

[52] U.S. Cl. ..... 100/92; 100/97; 100/229 A

[58] Field of Search ..... 100/92, 93 P, 94, 100/97, 229 A, 240, 245

[56] References Cited

U.S. PATENT DOCUMENTS

| | | | |
|---|---|---|---|
| 45,385 | 12/1864 | Brewer et al. | 100/94 |
| 2,602,483 | 7/1952 | Graham | 100/94 |
| 2,978,999 | 4/1961 | Smith | 100/93 P |
| 3,383,228 | 5/1968 | Rekate et al. | 100/229 A |
| 3,589,276 | 6/1971 | Swallert | 100/92 |
| 3,827,213 | 8/1974 | Matzinger | 100/93 P |
| 4,036,152 | 7/1977 | Bright | 100/229 A |
| 4,706,560 | 11/1987 | Capodicasa | 100/229 A |
| 4,860,958 | 8/1989 | Yerman | 100/93 P |
| 4,944,220 | 7/1990 | Fox | 100/229 A |
| 5,129,318 | 7/1992 | Zimmer | 100/229 A |
| 5,263,841 | 11/1993 | de Soet | 100/92 |

FOREIGN PATENT DOCUMENTS

| | | | |
|---|---|---|---|
| 0454122 | 10/1991 | European Pat. Off. | 100/92 |
| 275844 | 2/1990 | Germany | 100/92 |
| 1-181603 | 7/1989 | Japan | 100/92 |

*Primary Examiner*—Stephen F. Gerrity
*Attorney, Agent, or Firm*—Eugene Oak

[57] ABSTRACT

The present invention is a compacting apparatus for waste, glass, and plastic. The present invention compresses such objects in order to simplify both the recycling and disposal processes. Objects placed in a box within the apparatus are compressed by a flat surface perpendicularly attached to a vertical shaft. This shaft is pressed downward by a conventional hydraulic system installed in the top of the apparatus. One box is provided with heat-producing coils installed within its walls for softening hard plastic and PVC. Another box without heat-producing coils is provided for crushing glass and waste. A cutting device is provided for cutting objects too large to fit inside the box.

5 Claims, 5 Drawing Sheets

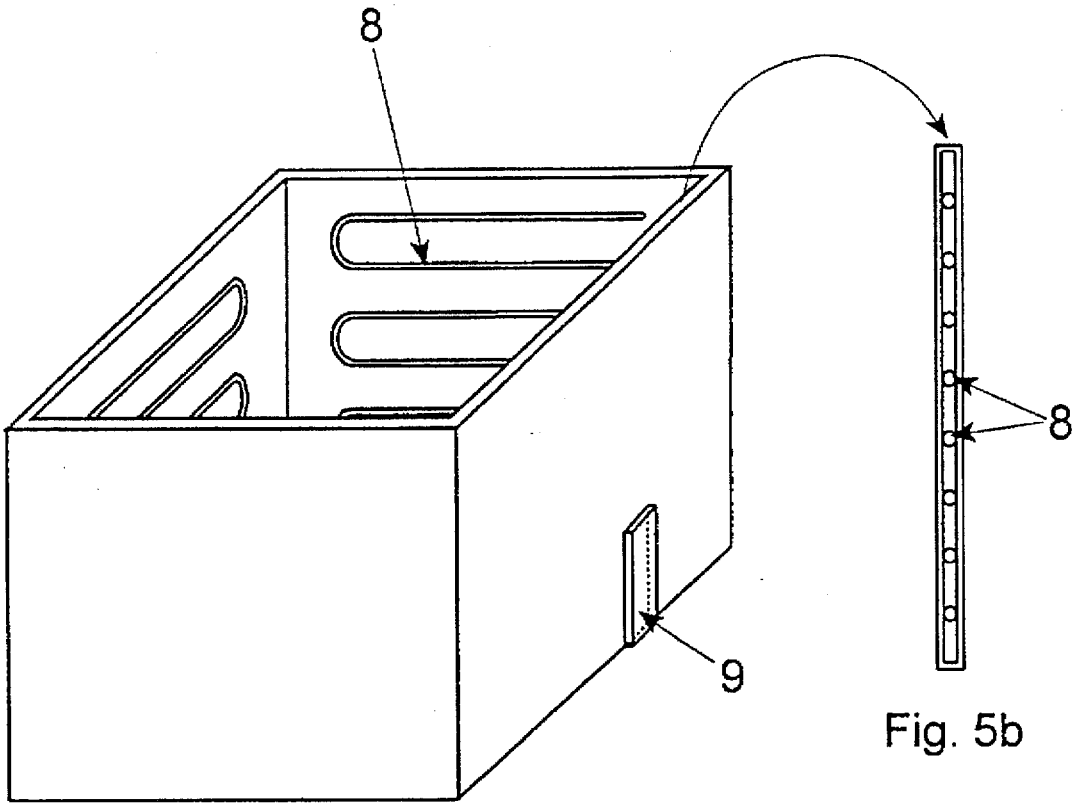
Fig. 5a
Fig. 5b
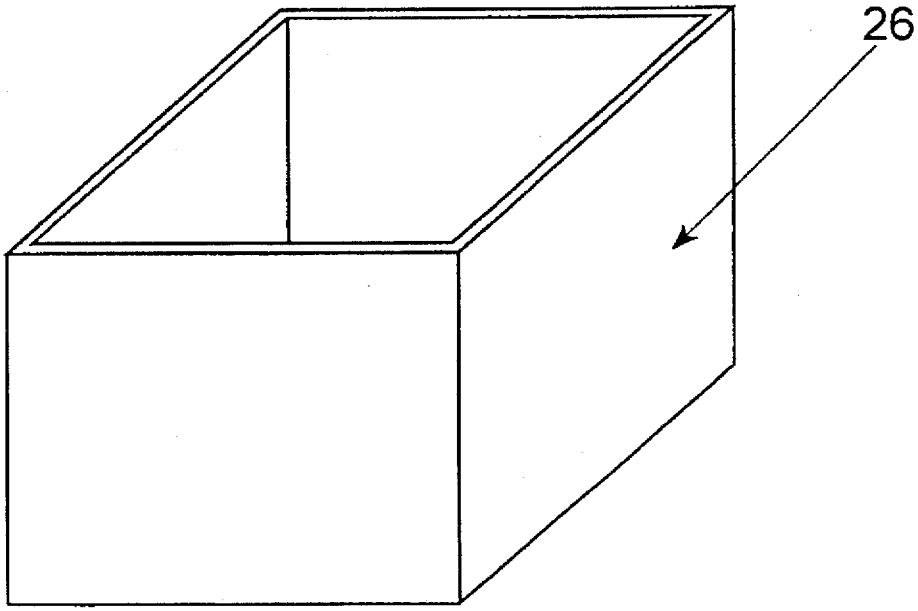
Fig. 6.

WASTE, GLASS, AND PLASTIC COMPACTOR

FIELD OF THE INVENTION

The present invention relates to a compacting apparatus, more particularly to a compacting apparatus which is able to compress waste, glass, and plastic.

BACKGROUND OF THE INVENTION

It is a commonly known fact that the available space in landfills is decreasing daily. Despite this fact, waste is continually produced in mass quantities every minute of every day. Recycling has been more widely utilized in recent years, but this process can be difficult because many people are not willing to cooperate.

Various devices have been developed in order to help people remedy the above-described problems within their own homes. Such devices are disclosed in U.S. Pat. Nos. 4,944,220 to Fox, which teaches a Trash Compactor for Sanitary Handling of Solid Waste, and 5,129,318 to Zimmer, which teaches a Revolving Recycling Compactor Having Multiple Containers.

There is no known device, however, which is able to efficiently compact waste, glass, and plastic for both recycling and disposal.

SUMMARY OF THE INVENTION

The present invention is a compacting apparatus for waste, glass, and plastic.

The exterior of the present invention is designed in much the same way as a tall microwave oven. A door is provided on the front of the apparatus with a control panel positioned to the right side of the door. Four legs are placed at the bottom of the apparatus, thereby suspending it off of the ground. Waste or glass placed within a box inside the apparatus is crushed and compacted by a hydraulic press. A heated box is provided for compacting plastic and PVC. A cutting device is provided on the side of the apparatus for cutting large objects to a size suitable for the box.

Thus, it is a primary object of the present invention to provide an apparatus which is able to compact waste, glass, and plastic.

It is another object of the present invention to provide a box within said apparatus for compacting waste and glass.

It is another object of the present invention to provide a heated box within said apparatus for compacting plastic and PVC.

It is another object of the present invention to provide a hydraulic press to be used in conjunction with said boxes.

It is another object of the present invention to provide a cutting device on the side of said apparatus.

These together with other objects of the invention are pointed out in the claims annexed to and forming a part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE PREFERRED EMBODIMENT

For a better understanding of the nature of the present invention, reference should be made to the following detailed description taken in connection with the accompanying drawings wherein:

FIG. 5A is a perspective view of the box used with the present invention to compact plastic and PVC. FIG. 5B is a cross-sectional view of one wall of the box.

FIG. 6 is a perspective view of the box used with the present invention to compact waste and glass.

DETAILED DESCRIPTION OF THE PREFERRED EMBODIMENT

Figure 1:
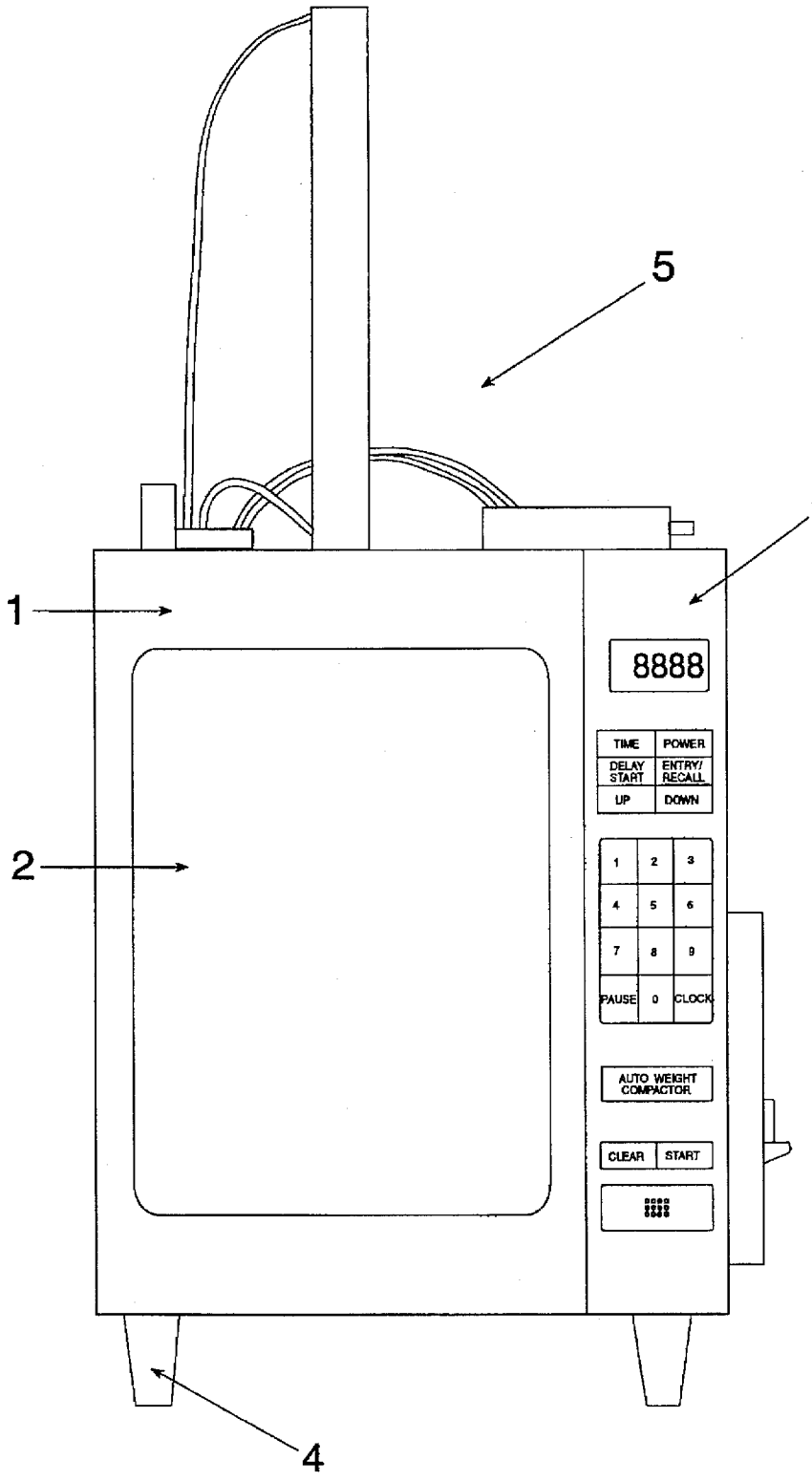
FIG. 1 is a frontal view of present invention.

Referring now to FIG. 1, a front view of the present invention is shown. The front of the apparatus comprises a door 1 with a window 2. A control panel, generally referred to as 3, is positioned to the right of the door 2. The control panel design shown is only for reference purposes and may be changed as the need arises. Four legs 4 are placed at each corner of the bottom of the apparatus, suspending it off of the ground. A hydraulic press, generally referred to as 5, is built into the top of the apparatus.

Figure 2:
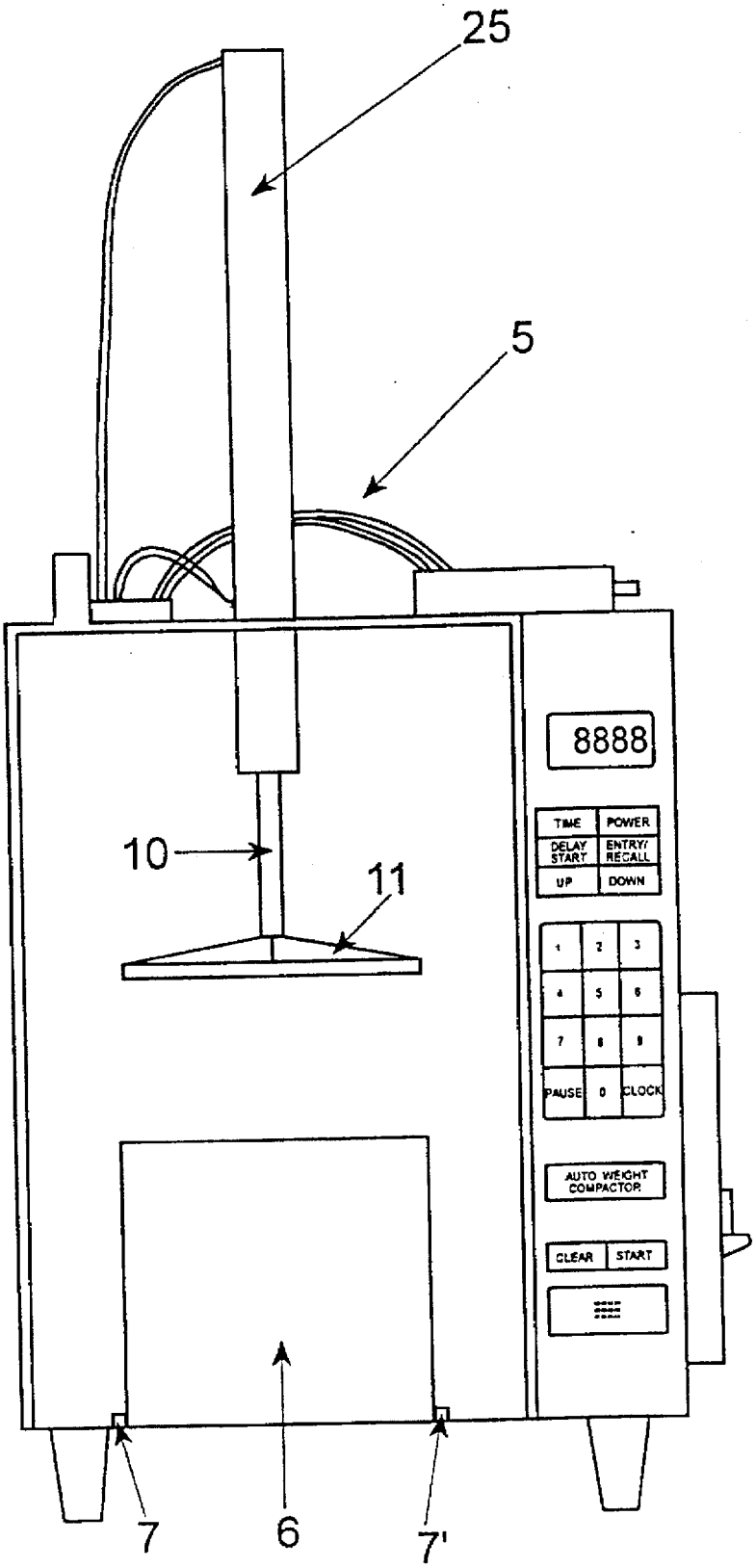
FIG. 2 is a frontal view of the present invention showing the interior elements.

Referring now to FIG. 2, a removable box 6 is placed within the apparatus and held in place by two opposing railings 7 and 7'. Two types of boxes are provided and are shown in FIGS. 5 and 6. The box shown in FIG. 5 is heated by coils 8 contained within the walls of the box. These heat-producing coils 8 are electrically connected to metal piece 9 which protrudes to the exterior of the box. A corresponding metal piece is positioned on the opposite side of the box. An electric current flows through the railings 7 and 7' attached to the base of the interior of the apparatus. As the box in FIG. 5 is placed between the railings 7 and 7', these metal pieces 9 draw electricity from the railings and thereby provide heat to the heat-producing coils 8. This box is used for compacting plastic and PVC, as the heat produced by the box aids in softening the hard materials, making them more easily compressible.

Another box is shown in FIG. 6. Like the first box, this box fits between the railings 7 and 7', but is not designed to produce heat and therefore does not require any external electrical input. This box is used for crushing and compacting both glass and waste.

Referring again to FIG. 2, after the objects desired to be compacted are placed into either of the two boxes, generally referred to as 6, a hydraulic press, generally referred to as 5, descends and crushes/compacts the contents of the box 6. The hydraulic press 5 comprises a tube 25 which houses a shaft 10. The air pressure within the tube 25 is controlled by a conventional hydraulic system attached to the top of the apparatus. Thus, the shaft 10 can be moved both downward and upward along the axis of the tube 25. A square-shaped flat surface 11 is perpendicularly attached to the shaft 10. As the shaft 10 is moved downward by the air pressure within the tube 9, the flat surface 11 descends into the box 6, thereby crushing/compacting the contents of the box 6.

Figure 3:
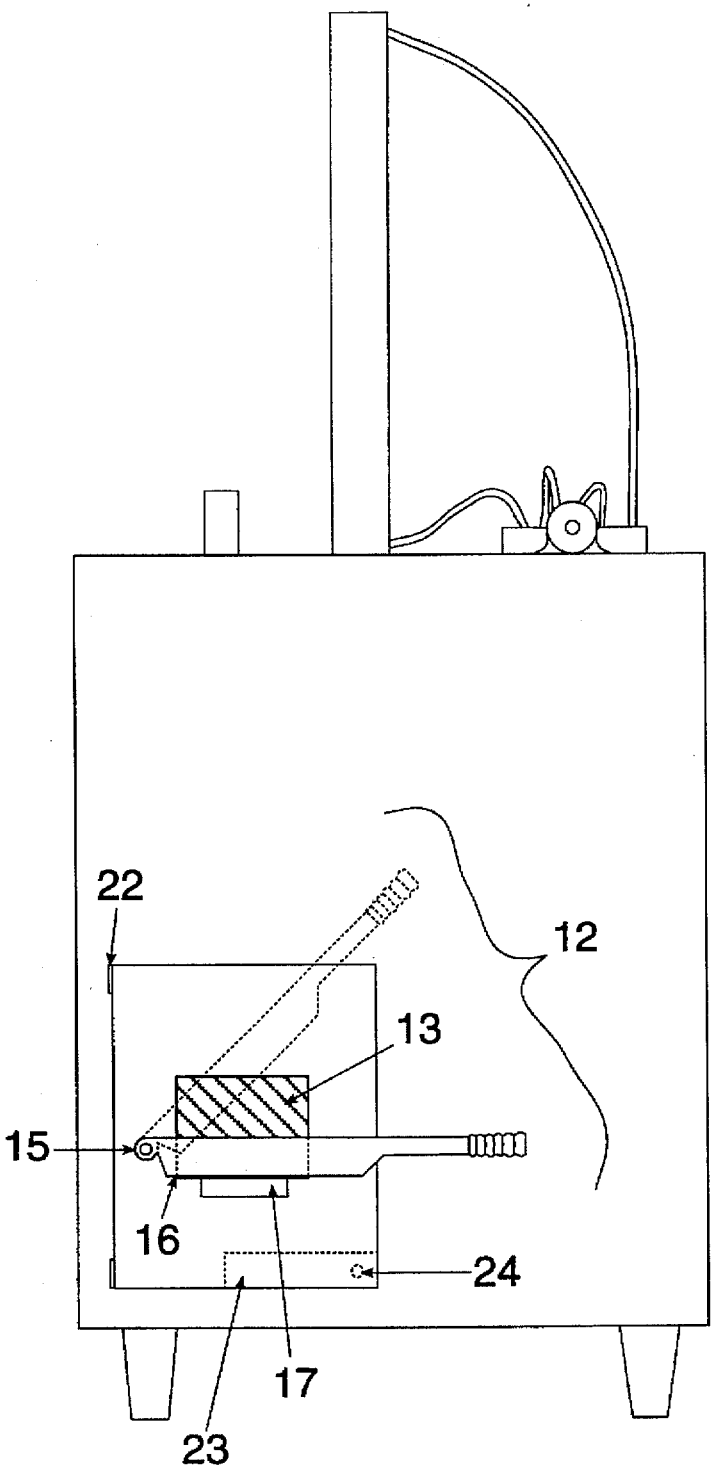
FIG. 3 is a side view of the present invention.
Figure 4:
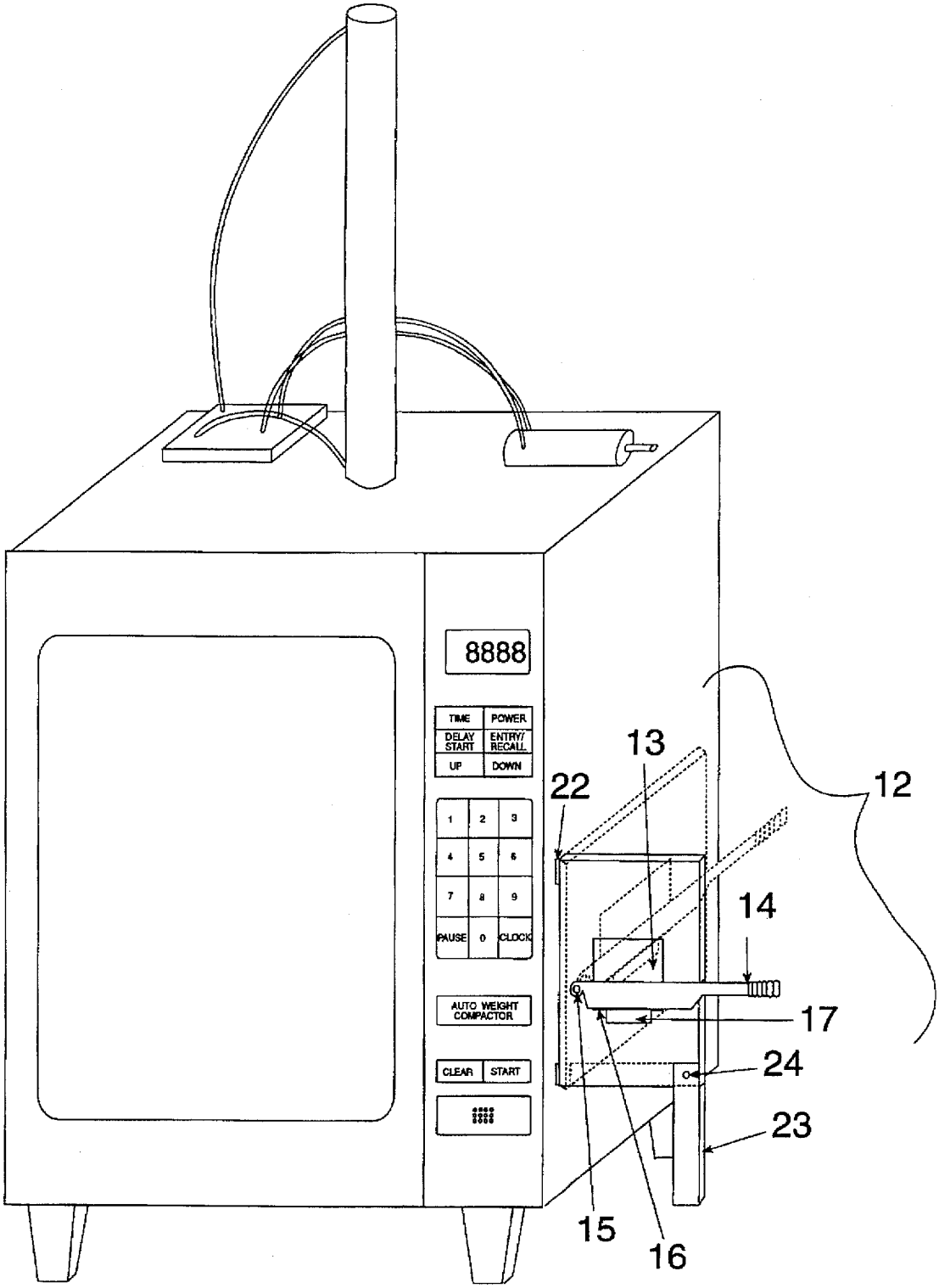
FIG. 4 is a perspective view of the present invention.

Referring now to FIGS. 3 and 4, a cutting device 12 is attached to the right side of the apparatus. The front edge of the cutting device 12 is pivotally attached to the apparatus by means of conventional hinges 22. When the user wishes to use the cutting device 12, he or she simply pulls it to the cutting position shown in FIG. 4. If the object to be cut is particularly hard or difficult to cut, the user may utilize the stabilizing leg 23, which is pivotally attached to the cutting device 12 by means of a screw 24. The leg 23 is simply pulled down 90 degrees from its stored position until it touches the ground.

The cutting device 12 contains a large hole 13 through which large objects may be placed. A lever 14 is pivotally attached to the device 12 by means of a hinge 15 and bears a sharp edge 16. An opposing sharp edge 17 is installed at the base of the hole 13. Thus, when a user wishes to compact an object which would otherwise be too large to fit into one of the boxes 6 of the present invention, he or she lifts the lever 14. The object is then held in the hole 13 between the two sharp edges 16 and 17. As the user pulls the lever 14 back to its original position, the object is cut by the sharp edges 16 and 17 as they cross each other at a very close proximity. When the user no longer needs the cutting device 12, he or she must lift the leg 23 back into its storage position and push the cutting device 12 back to its compacted state, shown in dotted lines in FIG. 4.

I claim:

1. A compacting apparatus for waste, glass, and plastic comprising:

a rectangularly shaped body having a front, a back, a right side, a left side, a top, a bottom, an interior area, said front having a right side area, and said interior area having a base;

a pivoting door on said front of said body;

a control panel on said right side area of said front of said body four legs attached to said bottom of said body; a compressing system attached to said top of said body;

a cutting device attached to said right side of said body;

two electric railings attached to said base of said interior area of said body;

a box with an open top designed to fit in between said railings.

2. A compressing system as in claim 1 wherein said compressing system comprises:

a tube having air therein protruding vertically through the center of said top of said body;

a shaft slidably inserted within said tube;

a square-shaped, flat surface perpendicularly attached to the base of said shaft;

a hydraulic system installed in said top of said body, said hydraulic system controlling pressure of said air within said tube such that said shaft may be moved both downward and upward along the axis of said tube.

3. A box as in claim 1 wherein said box has an open top, four walls, and a base, and comprises:

heat-producing coils installed within said walls of said box;

an exposed metal plate on either side of said box, each of said metal plates being electrically connected to said heat producing coils;

said metal plates positioned such that they come into electrical contact with said electric railings when placed between said electric railings.

4. A cutting device as in claim 1 wherein said cutting device is pivotally attached to said right side of said body and comprises:

a thin, rectangularly shaped frame;

a large, rectangular hole in the middle of said frame;

a sharp edge at the base of said hole;

a lever pivotally attached to said frame by means of a hinge;

a sharp edge on said lever;

movement of said lever such that said sharp edge on said lever can be pivoted between an open position and a closed position in relation to said sharp edge at the base of said hole, said movement facilitating the cutting of both large and hard objects by means of said sharp edges;

a stabilizing leg attached to said frame by means of a screw, said screw facilitating movement of said stabilizing leg between an open and closed position.

5. A box as in claim 1 wherein said box has an open top, four walls, and a base.

* * * * *